US009915018B2

(12) United States Patent
Kim et al.

(10) Patent No.: US 9,915,018 B2
(45) Date of Patent: Mar. 13, 2018

(54) WASHING MACHINE

(71) Applicant: LG ELECTRONICS INC., Seoul (KR)

(72) Inventors: Youngjun Kim, Seoul (KR); Insik Yu, Seoul (KR); Youngjong Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 245 days.

(21) Appl. No.: 14/736,702

(22) Filed: Jun. 11, 2015

(65) Prior Publication Data

US 2015/0361609 A1 Dec. 17, 2015

(30) Foreign Application Priority Data

Jun. 11, 2014 (KR) ..... 10-2014-0071032

(51) Int. Cl.

| | |
|---|---|
| ***D06F 37/12*** | (2006.01) |
| ***D06F 37/26*** | (2006.01) |
| ***D06F 37/24*** | (2006.01) |
| *D06F 23/04* | (2006.01) |

(52) U.S. Cl.

CPC ..... *D06F 37/12* (2013.01); *D06F 37/24* (2013.01); *D06F 23/04* (2013.01); *D06F 37/268* (2013.01)

(58) Field of Classification Search

CPC ..... D06F 37/12; D06F 37/24; D06F 37/268; D06F 23/04

USPC ..... 68/132

See application file for complete search history.

(56) References Cited

U.S. PATENT DOCUMENTS

| | | | | |
|---|---|---|---|---|
| 6,009,730 | A * | 1/2000 | Lee | D06F 37/20 68/23.1 |
| 2004/0226321 | A1 | 11/2004 | Park et al. | |
| 2011/0167878 | A1* | 7/2011 | De Angelo Sanchez | D06F 37/268 68/212 |
| 2014/0060120 | A1 | 3/2014 | Yu et al. | |

FOREIGN PATENT DOCUMENTS

| | | | | |
|---|---|---|---|---|
| KR | 20-1991-0003155 | Y1 | 5/1991 | |
| KR | 100195454 | B1 * | 12/1997 | D06F 37/24 |
| KR | 10-0381180 | B1 | 4/2003 | |
| KR | 10-2007-0046451 | A | 5/2007 | |

OTHER PUBLICATIONS

Park, KR100195454B1, Dec. 1997, Machine Translation.*

International Search Report and Written Opinion dated Sep. 21, 2015 issued in Application No. PCT/KR2015/005906 (English only).

* cited by examiner

*Primary Examiner* — Michael E Barr
*Assistant Examiner* — Tinsae B Ayalew
(74) *Attorney, Agent, or Firm* — KED & Associates, LLP

(57) ABSTRACT

A washing machine includes a casing, an exterior container disposed within the casing, configured to store washing water for washing, and supported to the casing, and a suspension module disposed between the exterior container and the casing and configured to buffer a vibration transferred from the exterior container to the casing. The suspension module includes a holder disposed between a horizontal suspension and a vertical suspension and configured to generate a relative movement in a length direction and to perform buffering on a vibration in a direction that crosses the length direction when the vibration is reduced.

19 Claims, 7 Drawing Sheets

WASHING MACHINE

CROSS-REFERENCE TO RELATED APPLICATION

This application claims priority under 35 U.S.C. § 119 to Korean Application No. 10-2014-0071032 filed on Jun. 11, 2014, whose entire disclosure is hereby incorporated by reference.

BACKGROUND

1. Field

The present disclosure relates to a washing machine.

2. Background

In general, a washing machine is an apparatus for washing the laundry using the emulsion action of a detergent, a water current action generated by the rotation of a washing container or washing wings, and an impact action applied by the washing wings. The washing machine performs a washing, rinse, or dehydration process in order to remove contaminations attached to the laundry using the action of a detergent and water.

A known washing machine includes a casing configured to form an external appearance of the washing machine, an exterior container received within the casing in such a way as to be suspended from the inside of the casing, and an interior container rotatably provided inside the exterior container. Furthermore, such a washing machine includes a suspension for attenuating a vibration generated when washing is performed.

In general, the suspension attenuates a vibration using the elastic force of a spring and the viscous force of a fluid. Such a suspension can effectively attenuate a vibration in a normal state in which the exterior container is vibrated within a specific amplitude range, but may not effectively attenuate a vibration if the vibration is generated out of the normal state.

In the known washing machine, a support member is connected to each of the corners of the outside of the casing, each of the support members is connected to the exterior container by the suspension, and the suspension chiefly buffers a vibration in the vertical direction of the exterior container.

Such a background method is effective in attenuating a vibration in the horizontal direction of the exterior container to some extent in a process of attenuating a vibration in a vertical direction that is generated in the exterior container. This is, however, only an additional effect generated in the process of reducing a vibration in the vertical direction of the exterior container. If a horizontal vibration is severe, for example, if eccentricity is generated in the interior container, there is a problem in that the operation of the washing machine must be stopped because a horizontal vibration is not buffered. See Korean Patent No. 10-0381180.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Figure 1:
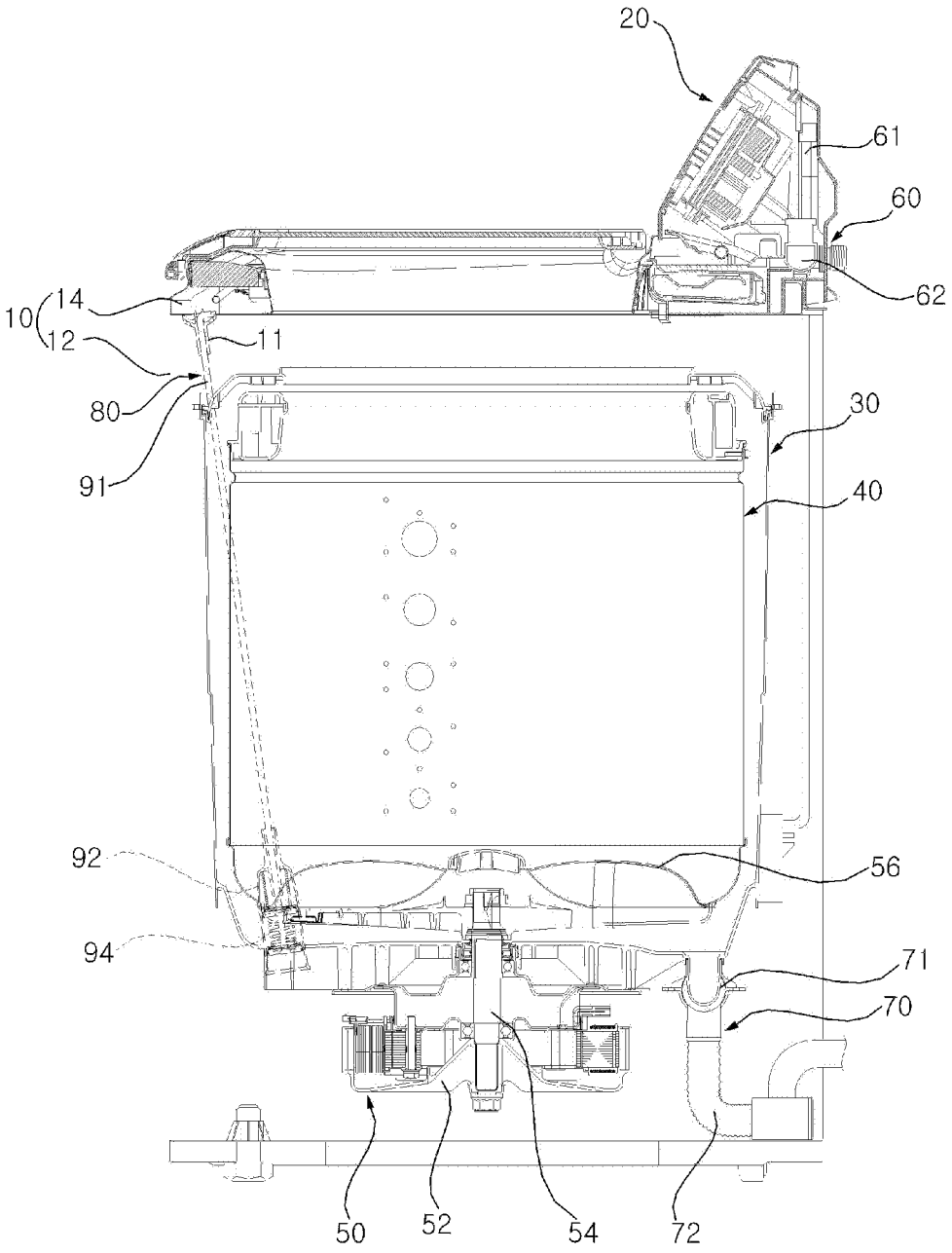
FIG. 1 is a cross-sectional view illustrating the inside of a washing machine in accordance with a first embodiment of the present disclosure.
Figure 2:
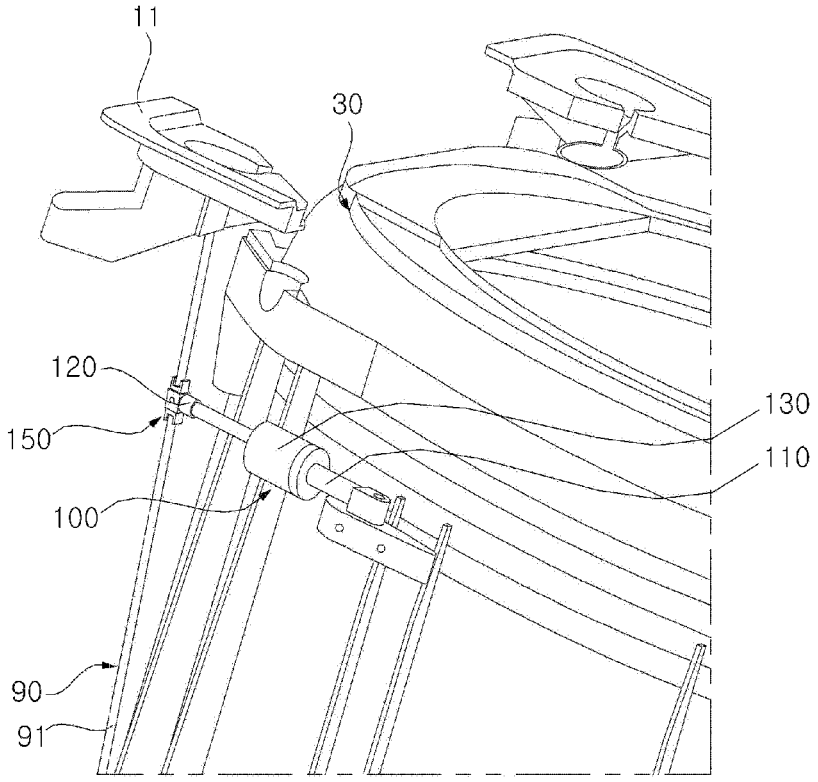
FIG. 2 is a perspective view of a suspension module illustrated in FIG. 1.

Referring to FIG. 1 or 2, a washing machine according to the present embodiment includes a casing 10 configured to form an external appearance and a control module 20 installed in the casing 10. The control module 20 is equipped with manipulation keys for receiving a manipulation force or a command from a user and a display for displaying information about the operation state of the washing machine.

The washing machine further includes an exterior container or a tub 30 disposed inside the casing 10 and configured to have washing water stored therein, and an interior container or drum 40 disposed inside the exterior container 30 and configured to have the laundry stored therein and washed. A driving module 50 is disposed in the exterior container 30 and configured to rotate the interior container 40 in order to wash the laundry. A water supply module 60 is configured to supply washing water to the interior container 40, and a draining module 70 is configured to discharge washing water stored in the interior container 40. A suspension module 80 is configured to reduce or buffer a vibration generated in the exterior container 30.

The casing 10 includes a main body 12 configured to have the exterior container 30 and the interior container 40 disposed therein, and a top cover 14 disposed over the main body 12. A door 7 is disposed in the top cover 14 and configured to open and close the casing 10.

The control module 20 is equipped with manipulation buttons and a dial for receiving a manipulation force from a user. The control module 20 includes a display unit (not illustrated) for delivering a variety of types of information about the washing machine to a user. In the present embodiment, the display unit is disposed in the top cover 14.

The exterior container 30 is connected to the water supply module 60, and stores washing water supplied by the water supply module 60. The exterior container 30 is connected to the draining module 70. The draining module 70 may externally discharge washing water stored in the exterior container 30.

The interior container 40 is disposed inside the exterior container 30. The interior container 40 is rotated by a driving force delivered by the driving module 50. The interior container 40 is configured to relatively rotate forward or backward with respect to the exterior container 30 or rotate about a vertical axis through a center of the interior.

In the present embodiment, the driving module 50 includes a motor 52 disposed under the exterior container 30, a driving shaft 54 connected to the interior container 40 through the exterior container 30, and a pulsator 56 disposed inside the interior container 40 and configured to selectively rotate in response to a driving force delivered by the motor 52. The pulsator 56 is disposed inside the interior container 40 and may be rotated forward or backward independently of the rotation of the interior container 40.

The water supply module 60 includes a water supply valve 61 and a water supply passage 62 disposed in the top cover 12. The draining module 70 includes a draining valve 71 connected to the exterior container 30 and a draining passage 72 connected to the draining valve 71.

The suspension module 80 is connected to the exterior container 30, and reduces a vibration generated in the exterior container 30 using at least one of an elastic force and an attenuation force. The suspension module 80 is disposed between the casing 10 and the exterior container 30.

The suspension module 80 includes a vertical suspension 90 configured to buffer or reduce a vibration in a vertical direction that is generated in the exterior container 30 and a horizontal suspension 100 disposed between the casing 10 and the exterior container 30 and configured to buffer or reduce a vibration in a horizontal direction that is generated in the exterior container 30. It does not mean that the vertical suspension 90 buffers or reduces only a vibration that belongs to vibrations generated in the exterior container 30 and that is generated in the vertical direction, but it means that the vibration in the vertical direction accounts for a significant portion of vibrations in several directions. Regarding the horizontal suspension 100, it should be understood that a vibration in the horizontal direction accounts for a significant portion of vibrations in several directions.

The vertical suspension 90 is installed in such a manner that the exterior container 30 is hung on the casing 10. The vertical suspension 90 minimizes a vibration that is generated from the exterior container 30 and transferred to the casing 10. A plurality of the vertical suspensions 90 is installed in the exterior container 30. The vertical suspension 90 connects the top cover 14 and the exterior container 30.

The vertical suspension 90 is configured to buffer a vibration using an elastic force. The vertical suspension 90 includes a vertical support member 91 configured to have one end assembled with the casing 10 and the other end assembled with the exterior container 30, a suspension housing 92 fixed to the exterior container 30, and an buffer member 94 installed in the suspension housing 92 and configured to reduce the vibration of the vertical support member 91. A spring may be used as the buffer member 94. The spring reduces a vibration transferred to the vertical support member 91 using an elastic force and a restoration force. A fluid having viscosity may be used as the buffer member 94. In this case, the vibration of the vertical support member 91 can be reduced using an attenuation force.

One end placed over the vertical support member 91 is installed in the casing 10 in such a way as to pivot. In the present embodiment, a vertical support unit 11 with which one end of the vertical support member 91 is combined in such a way as to pivot is formed in the casing 10.

The horizontal suspension 100 functions to buffer a vibration that belongs to vibrations generated in the exterior container 30 and that is generated in the horizontal direction. The horizontal suspension 100 may have one end connected to the exterior container 30 and the other end connected to the vertical support member 91. The horizontal suspension 100 is configured to relatively move or relatively rotate between the exterior container 30 and the vertical support member 91. The horizontal suspension 100 can buffer a vibration using at least one of an elastic force and an attenuation force.

In the present embodiment, the horizontal suspension 100 includes a first coupling unit 110 connected to the exterior container 30, a second coupling unit 120 connected to the casing 10 through the vertical support member 91, and an buffer unit 130 disposed between the first coupling unit 110 and the second coupling unit 120 and configured to buffer a vibration. The buffer structure of the buffer unit 130 may have been implemented in various ways by those skilled in the art, and a detailed description thereof is omitted. The washing machine further includes a holder 150 configured to connect the second coupling unit 120 and the vertical support member 91 and to reduce a vibration between the vertical suspension 90 and the horizontal suspension 100.

Figure 3:
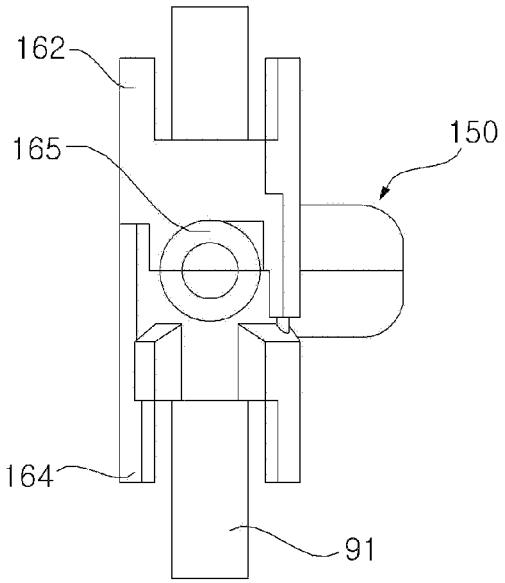
FIG. 3 is a front view of a holder illustrated in FIG. 2.
Figure 4:
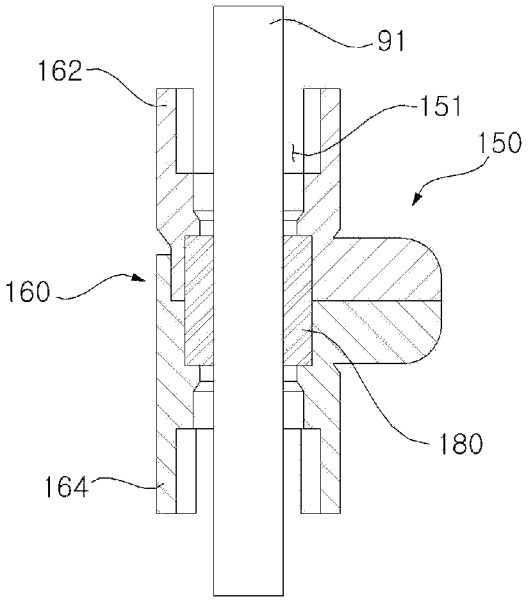
FIG. 4 is a front cross-sectional view of the holder illustrated in FIG. 3.
Figure 5:
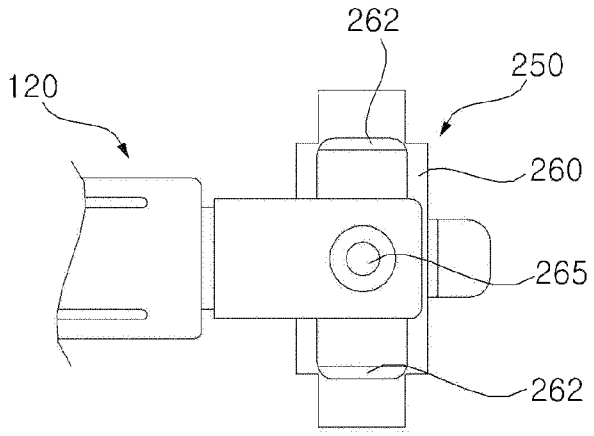
FIG. 5 is a front view illustrating the state in which the holder in accordance with a second embodiment of the present disclosure and a second coupling unit have been combined.
Figure 6:
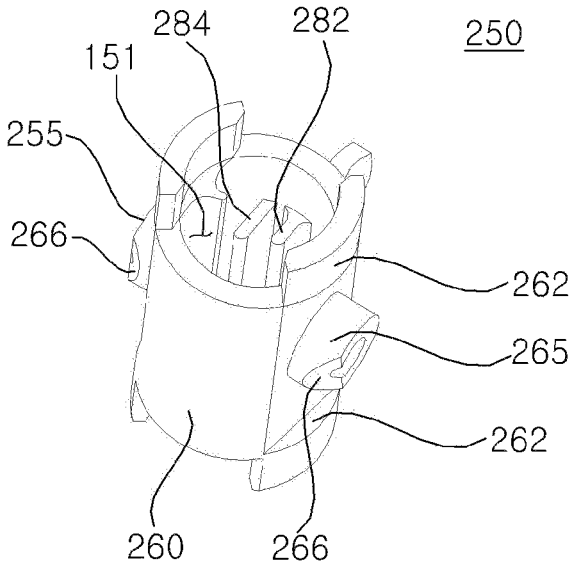
FIG. 6 is a perspective view of the holder illustrated in FIG. 5.
Figure 7:
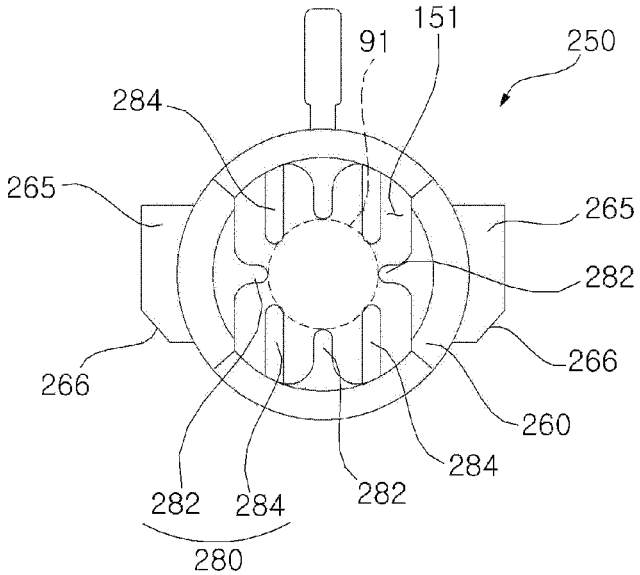
FIG. 7 is a plan view of the holder illustrated in FIG. 6.
Figure 8:
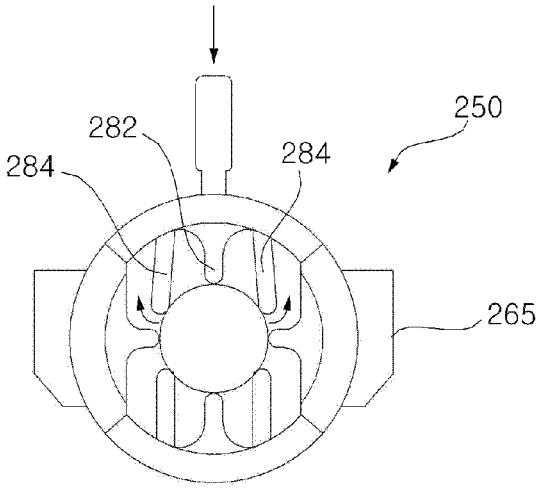
FIG. 8 is an operation example 1 of the holder illustrated in FIG. 7.
Figure 9:
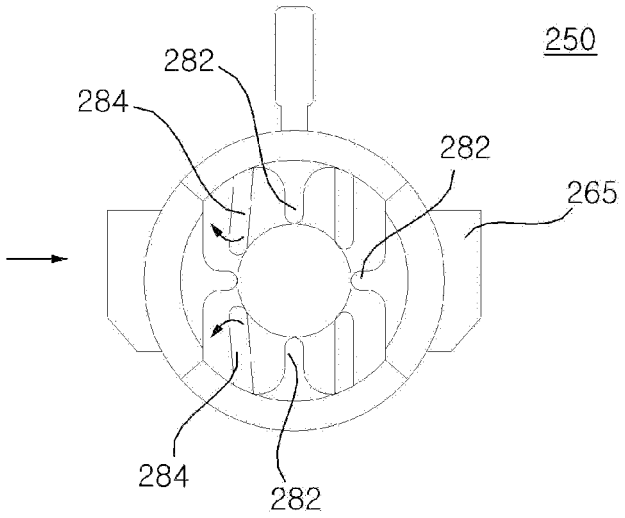
FIG. 9 is an operation example 1 of the holder illustrated in FIG. 7.

Referring to FIG. 3 or 4, the holder 150 is disposed between the vertical suspension 90 and the horizontal suspension 100 and configured to reduce a vibration or noise. The holder 150 includes a holder body 160 configured to include a first holder housing 162 and a second holder housing 164, a hollow 151 formed within the holder body 160 and configured to have the vertical support member 91 inserted therein, and a reduction member 180 placed in the hollow 151 and disposed between the holder body 160 and the vertical support member 91.

When a vibration is generated, the holder 150 according to the present embodiment may relatively move in the length direction of the vertical support member 91. The holder 150 can buffer a vibration in a direction that crosses the length direction of the vertical support member 91.

In the present embodiment, the holder body 160 may be formed of two parts: the first holder housing 162 and the second holder housing 164 that are assembled together.

A holder shaft 165 is formed outside the holder body 160. The second coupling unit 120 is combined with the holder shaft 165. The second coupling unit 120 and the holder body 160 may rotate around the holder shaft 165. In the present embodiment, the holder shaft 165 is formed by the combination of the first and the second holder housings 162 and 164. In the present embodiment, the first holder housing 162 is disposed on the upper side, and the second holder housing 164 is disposed on the lower side. The hollow of the first holder housing 162 and the hollow of the second holder housing 164 are connected.

The reduction member 180 is made of a material having elasticity. The reduction member 180 is disposed between the vertical support member 91 and the holder body 160. The reduction member 180 is closely attached to the vertical support member 91 and the holder body 160, thus providing an elastic force.

The reduction member 180 may be made of a synthetic material having elasticity. The reduction member 180 buffers a relative movement between the vertical support member 91 and the holder body 160 while being elastically deformed by the elasticity of the synthetic material. Furthermore, when the holder body 160 slips down the vertical support member 91, the reduction member 180 reduces a noise attributable to the slip.

Vibrations generated from the exterior container 30 are transferred to the vertical support member 91 and the holder body 160, and some of the vibrations are buffered by the elastic force of the reduction member 180. Furthermore, when the holder body 160 slips down the vertical support member 91, the reduction member 180 provides an elastic force while rubbing against the vertical support member 91 in the slipping process. In this case, the reduction member 180 can minimize a noise by the elastic force of the synthetic material.

The reduction member 180 is extended in the length direction of the vertical support member 91. The reduction member 180 may have a cylindrical shape that surrounds the outside of the vertical support member 91. The reduction member 180 separates the vertical support member 91 and the holder body 160 and prevents the vertical support member 91 and the holder body 160 from directly coming in contact with each other although vibrations are transferred in various directions.

The reduction member 180 prevents the vertical support member 91 and the holder body 160 from directly coming in contact with each other, thus reducing a contact noise or a friction noise. The holder 150 can suppress or minimize a slip with respect to vibrations generated in the length direction of the vertical support member 91 and can minimize the generation of a noise attributable to the slip. The holder 150 buffers vibrations in the direction that crosses the length direction of the vertical support member 91. In the present embodiment, the holder 150 has been illustrated as being combined with the vertical support member 91. In some embodiments, the holder 150 may be combined with another part of the vertical suspension 90. Furthermore, the holder 150 may be combined with the casing 10 other than the vertical suspension 90.

A holder according to a second embodiment is described below with reference to FIGS. 5 to 9. The holder 250 according to the present embodiment includes a holder body 260, the hollow 151 formed within the holder body 260 and configured to have the vertical support member 91 inserted therein, a reduction member 280 protruded from the holder body 260 to the hollow 151 and configured to reduce a noise or frication when the holder slips down the vertical support member 91 by supporting the vertical support member 91, a holder shaft 265 formed outside the holder body 260 and rotatably connected to the second coupling unit 120, and a stopper 262 formed outside the holder body 260 and configured to limit an angle in which the holder body 260 can rotate.

In the present embodiment, the holder body 260 is fabricated in a single part by ejection. The holder body 260 is made of a synthetic material. The hollow 151 is formed within the holder body 260, and the vertical support member 91 is inserted into the hollow 151. The stopper 262 is placed around the holder shaft 265.

When the holder body 260 rotates around the holder shaft 265, the stopper 262 is engaged with the second coupling unit 120. The rotation angle of the holder body 260 is restricted by the engagement with the second coupling unit 120.

A coupling guide surface 266 for being combined with the second coupling unit 120 by one touch is further formed in the holder shaft 265. The coupling guide surface 266 has an inclined surface. The holder shaft 265 has a generally pointed shape by the coupling guide surface 266. When the holder shaft 265 is pushed in the second coupling unit 120, the holder shaft 265 is inserted along the coupling guide surface 266.

The reduction member 280 includes first reduction units 282 extended from the holder body 260 to the center of the shaft of the holder 250 and configured to support the vertical support member 91 and second reduction units 284 protruded from the holder body 260 to the inside thereof and configured to support the outside surface of the vertical support member 91.

In the present embodiment, the reduction member 280 are integrated with the holder body 260. In some embodiments, the reduction member 280 may be configured as a part separate from the holder body 260. The first reduction units 282 are disposed in the direction normal to a surface of the vertical support member 91. Each of the second reduction unit 284 forms a specific included angle with the surface of the vertical support member 91 not in the normal direction.

The reduction member 280 may slip in the length direction of the vertical support member 91. The reduction member 280 may provide an elastic force in the radial direction of the vertical support member 91.

The first reduction units 282 and the second reduction units 284 are lengthily extended in the length direction of the vertical support member 91. The first reduction units 282 and the second reduction units 284 come in contact with the surface of the vertical support member 91.

In the present embodiment, four first reduction units 282 are disposed at an interval of 90 degrees. The second reduction units 284 are disposed between the first reduction units 282. At least one of the first reduction units 282 and the second reduction units 284 always comes in contact with the vertical support member 91. In the present embodiment, both the first reduction units 282 and the second reduction units 284 are disposed to come in contact with the vertical support member 91.

When a vibration or external force is transferred, at least one of the first reduction units 282 and the second reduction units 284 are elastically deformed, thus reducing a vibration or noise. For example, when the exterior container 30 vibrates in the horizontal direction, the first reduction units 282 support a force in the normal direction. When the exterior container 30 vibrates in the horizontal direction, the second reduction units 284 buffer the vibration while being elastically deformed within the hollow 151.

When the second reduction units 284 are elastically deformed, they remain contact with the vertical support member 91, thereby being capable of minimizing the generation of a noise. Although not illustrated, the reduction member 180 of the first embodiment may be disposed between the reduction member 280 and the vertical support member 91.

Furthermore, a material having an elastic force, such as the reduction member 180 of the first embodiment, may be inserted or filled between the first reduction units 282 and the second reduction units 284. In this case, the reduction member 180 of the first embodiment and the reduction member 280 of the second embodiment may be configured to have different elastic moduli in order to buffer a variety of types of vibrations.

The remaining elements are the same as those of the first embodiment, and a detailed description thereof is omitted.

Figure 10:
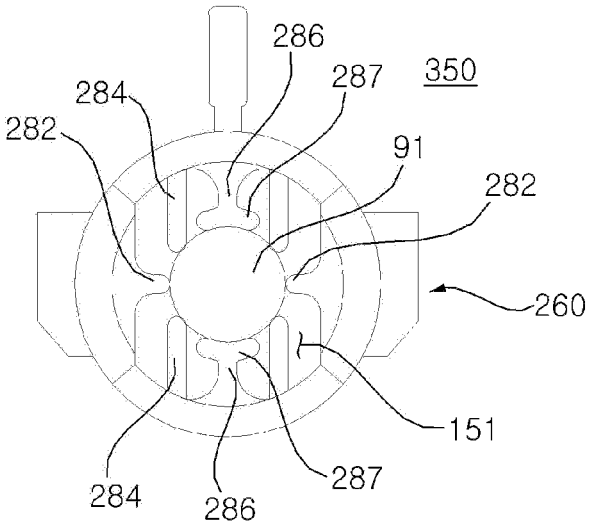
FIG. 10 is a plan view of a holder in accordance with a third embodiment of the present disclosure.

FIG. 10 is a plan view of a holder in accordance with a third embodiment of the present disclosure. Unlike in the second embodiment, the holder 350 according to the present embodiment is configured so that a reduction member 380 surrounds part of the surface of the vertical support member 91. In the present embodiment, first reduction units 286 are formed to surround part of the surface of the vertical support member 91.

The first reduction units 286 are formed in the holder body 260 and disposed in the direction normal to the surface of the vertical support member 91. A contact unit 287 configured to surround part of the surface of the vertical support member 91 is further formed at the end of each of the first reduction units 286. The contact unit 287 comes in a surface contact with the vertical support member 91, thus being capable of increasing a support force for an external force.

When an external force is transferred in a direction not in the normal direction, the contact unit 287 is elastically deformed, thereby being capable of reducing a vibration or noise. The contact unit 287 may be made of a material having a different elastic modulus from the material of the holder body 260. For example, the contact unit 287 may be made of a material having a high elastic modulus, such as urethane, and may be fabricated by dual ejection along with the holder body 260. Furthermore, the first reduction units 286 may be disposed in a direction not in the direction normal to the vertical support member 91.

The remaining elements are the same as those of the second embodiment, and a detailed description is omitted.

Figure 11:
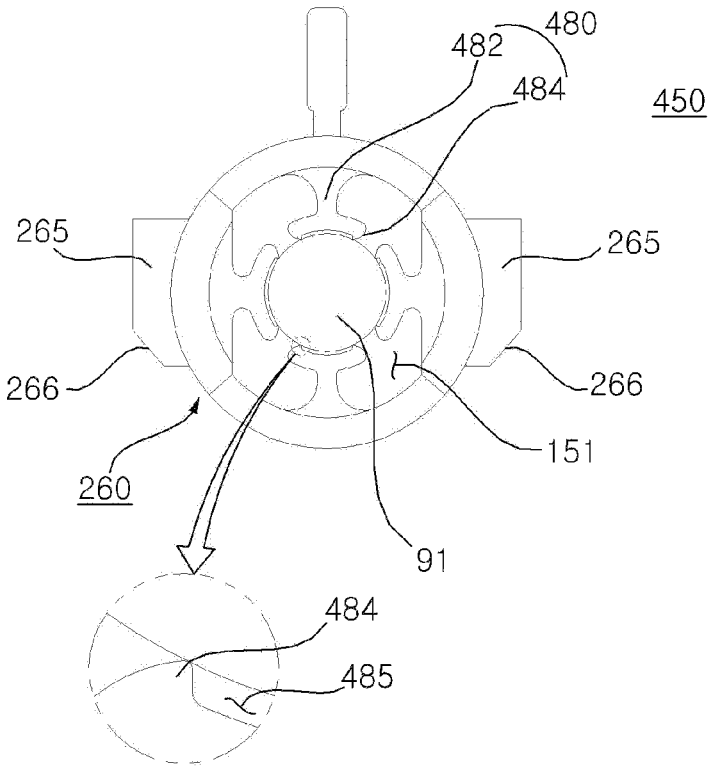
FIG. 11 is a plan view of a holder in accordance with a fourth embodiment of the present disclosure.

FIG. 11 is a plan view of a holder in accordance with a fourth embodiment of the present disclosure. Unlike in the second embodiment, the holder 450 according to the present embodiment is configured so that reduction members 480 comes in a point, line, or surface contact with the vertical support member 91. The reduction members 480 are protruded from the holder body 260 to the hollow 151, and come in contact with the vertical support member 91.

Each of the reduction members 480 includes a reduction support unit 482 protruded from the holder body 260 to the vertical support member 91 and a reduction buffer unit 484 connected to the reduction support unit 482 and configured to come in contact with the vertical support member 91 and provide an buffer force. The reduction buffer unit 484 is extended from the reduction support unit 482.

At least two parts of the reduction buffer unit 484 come in contact with the vertical support member 91. The reduction buffer unit 484 may come in a point, line, or surface contact with the vertical support member 91. In the present embodiment, the reduction buffer unit 484 is extended to both sides of the reduction support unit 482. The reduction buffer unit 484 is symmetrically placed on the basis of the reduction support unit 482.

In the present embodiment, four reduction members 480 may be disposed in the holder body 260 at an interval of 90 degrees. Unlike in the present embodiment, only one reduction member 480 may be disposed in the holder body 260, or three reduction members 480 may be disposed in the holder body 260 at an interval of 120 degrees.

The reduction member 480 may be symmetrically disposed inside the holder body 260. The reduction members 480 may be disposed inside the holder body 460 at equal intervals. In the present embodiment, buffer spaces 485 are formed between the reduction buffer units 484 and the vertical support member 91.

In this case, when the holder 450 closely adheres to the vertical support member 91, the reduction buffer units 484 are deformed, and thus the buffer spaces 485 disappear. Accordingly, the entire surfaces of the reduction buffer units 484 closely adhere to the surface of the vertical support member 91.

When a vibration or external force is applied, the reduction buffer units 484 closely adhere to the surface of the vertical support member 91, thereby being capable of elastically supporting the vertical support member 91. Accordingly, complex buffer can be performed through the buffer spaces 485.

That is, in the state in which the buffer spaces 485 have been formed, if the buffer forces of the reduction members 480 and the buffer spaces 485 have become extinct, the reduction members 480 have different buffer forces.

In particular, the reduction buffer unit 484 has a small contact area because it comes in a point or line contact with the vertical support member 91. If the vertical support member 91 and the reduction buffer unit 484 have a small contact area, the generation of a noise can be minimized.

The remaining elements are the same as those of the second embodiment, and a detailed description thereof is omitted.

The washing machine in accordance with an embodiment of the present disclosure has an advantage in that it can reduce a vibration in the horizontal direction of the exterior container.

Furthermore, the washing machine in accordance with an embodiment of the present disclosure has an advantage in that it can reduce the generation of a noise when reducing vibrations.

Furthermore, the holder of the washing machine in accordance with an embodiment of the present is advantageous in that it can relatively move in the length direction with respect to a vibration in the vertical direction.

Furthermore, the holder of the washing machine in accordance with an embodiment of the present disclosure is advantageous in that it can buffer a vibration by transferring a vibration in the horizontal direction to the horizontal suspension.

Furthermore, the holder of the washing machine in accordance with an embodiment of the present disclosure is advantageous in that it can reduce the generation of a noise through the elastic deformation of the reduction member that has closely adhered to the vertical support member.

A washing machine is capable of reducing a vibration in the horizontal direction of an exterior container through a holder that connects a vertical suspension and a horizontal suspension.

A washing machine is capable of minimizing a noise generated from the holder that connects the vertical suspension and the horizontal suspension.

A holder is configured to connect the vertical suspension and the horizontal suspension relatively moves when a vibration in the vertical direction of the exterior container is generated.

There is provided a washing machine, which includes a casing, an exterior container disposed within the casing, configured to store washing water for washing, and supported to the casing, and a suspension module disposed between the exterior container and the casing and configured to buffer a vibration transferred from the exterior container to the casing. The suspension module includes a vertical suspension disposed between the casing and the exterior container and configured to reduce a vibration in a vertical direction that is transferred by the exterior container, a horizontal suspension disposed between the vertical suspension and the exterior container and configured to reduce a vibration in a horizontal direction that is transferred by the exterior container, and a holder disposed between the horizontal suspension and the vertical suspension and configured to generate a relative movement in a length direction and to perform buffering on a vibration in a direction that crosses the length direction when the vibration is reduced.

The vertical suspension may be disposed through the holder. A reduction member may be disposed between the vertical suspension and the holder. The reduction member may generate a relative movement in the length direction of the vertical suspension when a vibration is generated in the length direction of the vertical suspension and performs buffering by elasticity when the vibration is generated in the direction that crosses the length direction.

The reduction member may be formed to surround the vertical suspension.

The holder may include first and second holder housings each configured to have a hollow formed in the holder housing, and the reduction member may be disposed in the hollow. The holder may further include a holder shaft. The holder may be disposed in such a way as to rotate around the holder shaft at a specific angle between the vertical suspension and the horizontal suspension.

The vertical suspension may include a vertical support member configured to hang the exterior container on the casing, and the holder may be disposed in such a way as to relatively move in the length direction of the vertical support member.

The holder may include a holder body, a hollow formed within the holder body and configured to have the vertical support member inserted into the hollow, a reduction member disposed between the holder body and the vertical support member and configured to support the vertical support member, and a holder shaft formed outside the holder body and rotatably connected to the horizontal suspension.

The holder may further include a stopper formed outside the holder body, engaged with the horizontal suspension, and configured to limit the rotation of the holder body.

The reduction member may include a first reduction unit is formed to extend from the holder body to the center of the shaft of the holder and configured to support the vertical support member and a second reduction unit is formed to protrude from the holder body to the hollow and configured to support the outside surface of the vertical support member.

The first reduction unit may be disposed in the direction normal direction respect to a surface of the vertical support member.

A plurality the first reduction units may be disposed, and the second reduction unit may be disposed between the first reduction units.

The first reduction unit may be formed to surround part of the surface of the vertical support member.

The holder may include a holder body, a hollow formed within the holder body and configured to have the vertical support member inserted into the hollow, a reduction member protruded from the holder body to the hollow and configured to form at least one of point, line, and surface contacts with the vertical support member, and a holder shaft formed outside the holder body and rotatably connected to the horizontal suspension.

The reduction member may include a reduction support unit is formed to protrude from the holder body to the vertical support member and a reduction buffer unit connected to the reduction support unit and configured to closely adhere to the vertical support member and provide an elastic force.

A buffer space may be formed between the reduction buffer unit and the vertical support unit.

A plurality of the reduction buffer units may be formed in the reduction support unit and symmetrically disposed based on the reduction support unit.

There is provided a washing machine which includes a casing, an exterior container disposed within the casing, configured to store washing water for washing, and supported to the casing, and a suspension module disposed between the exterior container and the casing and configured to buffer a vibration transferred from the exterior container to the casing. The suspension module includes a vertical suspension disposed between the casing and the exterior container and configured to reduce a vibration in a vertical direction that may be transferred by the exterior container, a horizontal suspension disposed between the vertical suspension and the exterior container and configured to reduce a vibration in a horizontal direction that may be transferred by the exterior container, a holder disposed between the horizontal suspension and the vertical suspension and configured to generate a relative movement in a length direction and to perform buffering on a vibration in a direction that crosses the length direction when the vibration may be reduced, and a reduction member disposed between the vertical suspension and the holder, installed to surround the vertical suspension, and configured to closely adhere to the vertical suspension and provide an elastic force.

There is provided a washing machine which includes a casing, an exterior container disposed within the casing, configured to store washing water for washing, and supported to the casing, and a suspension module disposed between the exterior container and the casing and configured to buffer a vibration transferred from the exterior container to the casing. The suspension module may include a vertical suspension disposed between the casing and the exterior container and configured to reduce a vibration in a vertical direction that may be transferred by the exterior container, a horizontal suspension disposed between the vertical suspension and the exterior container and configured to reduce a vibration in a horizontal direction that may be transferred by the exterior container, a holder disposed between the horizontal suspension and the vertical suspension and configured to generate a relative movement in a length direction and to perform buffering on a vibration in a direction that crosses the length direction when the vibration may be reduced, and a reduction member integrated with the holder, protruded toward the vertical suspension, and configured to closely adhere to the vertical suspension and provide an elastic force.

The vertical suspension may include a vertical support member configured to hang the exterior container on the casing. The vertical support member may be disposed to penetrate the holder. The reduction member may closely adhere to the vertical support member and provide the elastic force. The reduction member may include a first reduction unit disposed in the direction normal to a surface of the vertical support member and configured to support the vertical support member and a second reduction unit disposed to form an included angle to the surface of the vertical support member not the normal direction and configured to support the vertical support member.

The first reduction unit may include a contact unit configured to surround part of the surface of the vertical support member.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A washing machine, comprising:

a casing;

a tub provided within the casing, configured to store washing water, and supported by the casing; and a suspension disposed between the, exterior container and the casing and configured to buffer a vibration transferred from the exterior container to the casing, wherein the suspension includes:

a vertical suspension provided between the casing and the exterior container and configured to reduce a vibration in a vertical direction;

a horizontal suspension provided between the vertical suspension and the exterior container and configured to reduce a vibration in a horizontal direction; and a holder to couple the horizontal suspension and the vertical suspension, wherein the holder includes a reduction member having at least one first rib extending in a normal direction with respect to surface of the vertical support and at least one second rib extending parallel to the first rib and having an end contact the surface of the vertical support in a non-normal direction.

2. The washing machine of claim 1, wherein:

the vertical suspension is provided through the holder, the reduction member is disposed between the vertical suspension and the holder, the reduction member being configured to move in the length direction of the vertical suspension when a vibration is generated in the length direction of the vertical suspension and performs elastic buffering when the vibration is generated in the direction that crosses the length direction.

3. The washing machine of claim 2, wherein the reduction member is formed to surround the vertical suspension.

4. The washing machine of claim 2, wherein the holder includes first and second holder housings to form a hollow interior, the reduction member being provided in the hollow interior.

5. The washing machine of claim 1, wherein the holder farther includes a holder shaft, the holder being configured to rotate around the holder shaft at a specific angle between the vertical suspension and the horizontal suspension.

6. The washing machine of claim 1, wherein the vertical suspension includes a vertical support configured to hang the exterior container on the casing, and the holder is configured to move in the length direction of the vertical support.

7. The washing machine of claim 6, wherein the holder includes:

a holder body having a hollow interior configured to receive the vertical support;

the reduction member provided between the holder body and the vertical support and configured to support the vertical support; and a shaft holder formed outside the holder bode and rotatably connected to the horizontal suspension.

8. The washing machine of claim 7, wherein the holder further comprises a stopper formed outside the holder body, the stopper configured to engage with the horizontal suspension, and to limit a rotation of the holder body.

9. The washing machine of claim 1, wherein the at least one first rib includes a plurality of the first ribs, the second rib being provided between the plurality of first ribs.

10. The washing machine of claim 1, wherein the at least one first rib surrounds part of the surface of the vertical support.

11. The washing machine of claim 7, wherein the holder comprises:

a holder body having a hollow interior and configured to receive the vertical support inserted into the hollow interior;

the reduction member protruding from the holder body in the hollow interior and configured to form at least one of point, line, or surface contact with the vertical support; and a shaft holder formed outside the holder body and rotatably connected to the horizontal suspension.

12. The washing machine of claim 11, wherein the at least one first rib comprises:

a reduction support protruding from the holder body to the vertical support; and at least one reduction buffer connected to the reduction support and configured to closely adhere to the vertical support and configured to provide an elastic force.

13. The washing machine of claim 12, wherein a buffer space is formed between the at least one reduction buffer and the vertical support.

14. The washing machine of claim 12, wherein the at least one reduction buffer comprises a plurality of the reduction buffer symmetrically disposed based on the reduction support.

15. The washing machine of claim 1, wherein the reduction member further includes at least one third rib extending perpendicular to the at least one first rib in a normal direction with respect to the surface of the vertical support.

16. A washing machine, comprising:

a casing;

an exterior container disposed within the casing, and configured to store washing water, the exterior container being supported by the casing; and a suspension module disposed between the exterior container and the casing and configured to buffer a vibration of the exterior container, wherein the suspension module comprises:

a vertical suspension provided between the casing and the exterior container and configured to reduce, a vibration of the exterior container in a vertical direction;

a horizontal suspension provided between the vertical suspension and the exterior container and configured to reduce a vibration of the exterior container in a horizontal direction;

a holder to couple the horizontal suspension and the vertical suspension; and a reduction member integrated with the holder, protruded toward the vertical suspension, and configured to closely adhere to the vertical suspension and, provide an elastic force, wherein the reduction member includes a plurality of elastic ribs including at least one first elastic rib extending in a normal direction with respect to a surface of the vertical suspension and at least one second elastic rib extending perpendicullar to the at least one first elastic rib and having an end contact the surface of the vertical suspension in a non-normal direction.

17. The washing machine of claim 16, wherein:

the vertical suspension includes a vertical support member configured to hang the exterior container on the casing, the vertical support member pentrates the holder, and the reduction member closely adheres to the vertical support member and provides elastic force.

18. The washing machine of claim 16, wherein the at least one first elastic rib includes a contact unit configured to surround part of the surface of the vertical support member.

19. A washing machine comprising;

a casing having a first opening at a top surface;

a tub provided in the casing and having a second opening aligned with the first opening;

a rotatable drum provided in the tub and having a third opening aligned with the first opening;

a motor configured to rotate the rotatable drum; and a suspension configure to support the tub to the casing, the suspension including:

a first shaft extending in a vertical direction and having one end coupled to the casing and another end coupled a vibration or shock absorber provided at the bottom of the tub, a second shaft extending in a horizontal directional and, having one end coupled to a side of tub, and a coupler to couple the first and second shafts, the coupler having a hollow interior, at least one elastic buffer provided in the hollow interior and a shaft holder configured to couple to another end of the second shaft, the first shaft extending through the hollow interior of the coupler and being held against the at least one elastic buffer such that the coupler is moveable along the vertical shaft based on the elasticity of the at least one elastic buffer, wherein the at least one elastic buffer includes a support tab extending from the coupler in a normal direction with respect to a surface of the first shaft and reduction buffer attached to an end of the support tab and partially wrapping around the first shaft, wherein both ends of the reduction buffer contact the first shaft such that a gap is formed between the first shaft and the reduction buffer in a middle portion of the reduction buffer.

* * * * *